US010433699B2

(12) United States Patent
Williams et al.

(10) Patent No.: US 10,433,699 B2
(45) Date of Patent: Oct. 8, 2019

(54) DURALOCK SCRUBBER ATTACHMENT

(71) Applicants: Todd Allen Williams, Huntington Beach, CA (US); Cynthia Kay Williams, Huntington Beach, CA (US)

(72) Inventors: Todd Allen Williams, Huntington Beach, CA (US); Cynthia Kay Williams, Huntington Beach, CA (US)

( * ) Notice: Subject to any disclaimer, the term of this patent is extended or adjusted under 35 U.S.C. 154(b) by 311 days.

(21) Appl. No.: 15/584,244

(22) Filed: May 2, 2017

(65) Prior Publication Data

US 2017/0319041 A1 Nov. 9, 2017

Related U.S. Application Data

(60) Provisional application No. 62/331,804, filed on May 4, 2016.

(51) Int. Cl.

| | |
|---|---|
| ***A47L 13/12*** | (2006.01) |
| ***A47L 13/24*** | (2006.01) |
| ***A46B 15/00*** | (2006.01) |
| ***A47L 13/255*** | (2006.01) |
| *A47L 13/44* | (2006.01) |

(52) U.S. Cl.

CPC ..... *A47L 13/12* (2013.01); *A46B 15/0055* (2013.01); *A46B 15/0081* (2013.01); *A47L 13/24* (2013.01); *A47L 13/255* (2013.01); *A46B 2200/302* (2013.01); *A47L 13/44* (2013.01)

(58) Field of Classification Search

CPC ..... A47L 13/12; A47L 13/24; A47L 13/44; A46B 15/055; A46B 15/0081

See application file for complete search history.

(56) References Cited

U.S. PATENT DOCUMENTS

| | | | | |
|---|---|---|---|---|
| 798,172 | A | 8/1905 | Ducret | |
| 2,689,131 | A | 9/1954 | Priest | |
| 4,642,837 | A | 2/1987 | Nichols et al. | |
| 5,172,447 | A | 12/1992 | Tomm | |
| 5,890,254 | A | 4/1999 | Courtney et al. | |
| 6,216,306 | B1 | 4/2001 | Esterson et al. | |
| 6,247,199 | B1 | 6/2001 | Petner | |
| 7,124,464 | B2 * | 10/2006 | Williams | A47L 13/12 15/115 |
| 8,397,338 | B2 | 3/2013 | Dihn | |
| 8,561,245 | B2 | 10/2013 | Weis | |
| 2009/0113651 | A1 | 5/2009 | Giacolo et al. | |
| 2016/0207190 | A1 | 7/2016 | Balz et al. | |

* cited by examiner

*Primary Examiner* — Shay Karls

(74) *Attorney, Agent, or Firm* — Kirk A. Buhler; Buhler & Associates Patenting

(57) ABSTRACT

A DuraLock scrubber and scraper attachments with replaceable surface scrubbing and scraping capability, that includes providing a removable/replaceable surface scrubbing and scraping attachments, and attaching the elements to the mop head holder for scrubbing and scraping the floor surface. This provides a mop handle with surface scrubbing and scraping capability and includes an attachment for rigid connection to a mop handle, which is adapted to carry replaceable surface cleaning element(s). The replaceable elements can be a scraper, scrubbing pad or bristles or other abrasive materials that can be interchanged or replaced depending upon the job or as the components wear without requiring removal of the mop head and further allows the replacement of the mop head without requiring removal and reinstallation of the elements.

20 Claims, 8 Drawing Sheets

DURALOCK SCRUBBER ATTACHMENT

CROSS REFERENCE TO RELATED APPLICATIONS

This application claims the benefit of Provisional Application Ser. No. 62/331,804 filed May 4, 2016 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a DuraLock scrubber attachment that is suitable for cleaning various floors with rough and porous surfaces such as clay, porcelain, glazed and concrete floor surfaces.

Description of Related Art including information disclosed under 37 CFR 1.97 and 1.98.

A typical mop implement comprises a bundle of fabric rags or yarns attached to the end of a mop handle. During a cleaning operation, the operator first dips the absorbent material of the mop head into a cleaning fluid (typically water with dissolved detergent) and then moves the mop head back and forth or in a figure eight motion on the floor surface to be cleaned. One problem with this type of mop implement is that although it can efficiently wipe smooth surfaces and remove loose debris and dirt, the mop cannot efficiently remove tough ground-in dirt, grease and hardened materials which is either built up in the grout lines of tiles, accumulate in the pores on the floor surface or adhere to the surface because the absorbent material is too soft and the contact area between the absorbent material and the floor surface is relatively large. With rough and porous floor surfaces, the contaminations tend to become stuck to the floor surface and accumulate within the pores of the floor surface. In many applications, a rough and porous floor surface is preferred for certain purposes, such as slip and fall protection. The floor of a restaurant's kitchen is typically made of clay or porcelain tiles with rough porous surfaces to protect people from slipping. To maintain this kind of floor surface, the ground-in dirt, grease and particles stuck to or accumulated within the porous surface must be periodically removed by manual scrubbing using a scrub brush with sufficiently hard bristles or abrasive pads. Preferably, a scrub brush or abrasive pad is used on such a floor at least once per day. However, in actual practice, a scrub brush or abrasive pad is used far less frequently, resulting in unnecessarily slippery and contaminated floor surfaces.

The combination of a mop and a scrub brush or abrasive pad into a single cleaning apparatus has been disclosed in the prior art, but solely for the purpose of allowing the user thereof to scrub scuff marks and other stains. In Canadian Patent No. 737,140, a combination floor mop is disclosed, which has a brush attachment that is articulated with manual operation of the handle. By tilting the handle against the mop holder at different angles, the brush can be put in a position either in direct contact or out of contact with the floor surface. Therefore, the operator can choose to use the mop or the brush alone, or to use both of them at the same time. Although certain advantages have been achieved by this cleaning apparatus, it has several significant disadvantages. First, the positions of the mop and the brush relative to the floor surface to be cleaned can only be adjusted by tilting the handle against the mop holder. For example, when the handle is in a vertical position (the handle is perpendicular to the mop holder surface) the brush is brought out of contact with the floor surface, when the handle is in a substantially horizontal position (the handle is parallel to the mop holder surface) the brush is moved forward to be in direct contact with the floor surface. Thus, in order to conduct different operation modes, the operator must operate the cleaning apparatus at different angles between the handle and mopping surface, and under certain angles it is very difficult and uncomfortable to operate. Secondly, the adjustable range of the brush is very limited.

U.S. Pat. No. 7,124,464 discloses a Scrubbing device attachable to a mop where the scrubbing device is clamped onto the mop handle. The entire device must be unclamped from the handle of the mop for removal or replacement of the mop head and the mop head must be removed to replace the scrubbing device. Once fastened, the mop handle and mop holder act as a clamp to hold the scrubbing device against the mop head. Consequently, considerable effort is required to remove or replace the scrubbing device, and it must be removed and reinstalled every time a mop head is replaced or adjusted, which can be very frequent. Due to having to remove the scrubbing device when changing the mop head, the device can become lost or broken, or simply not be reinstalled.

A common problem of the combined mop and scrubbing elements disclosed in the prior art is that the relative positions of the scrubbing elements and the absorbent material cannot be easily and independently adjusted for the purpose of providing different operation modes and an easy access to replacing and cleaning of the mop and the scrubbing element. Therefore, a need still exists for providing a cleaning apparatus for cleaning and scrubbing a floor surface, especially a rough and porous surface. Such cleaning apparatus should be readily adjustable to meet the cleaning requirements of different surfaces, should be easily replaceable and should not require removal of the device in order to replace a mop head and should allow for easy interchange of scrubbing attachments. A faster removal and securing method must be devised that allows for these requirements. Additionally, the scrubbing element should be attached to the mop handle as close as possible to the mop headband to allow for reduction in additional weight and raw material costs of the scrubbing element and the mounting mechanisms.

There is a need for improvements in surface scrubbing and mopping whereby the two operations are enabled by incorporating a quickly releasable securing system for attachment of a scrubbing pad or brush on a flexible joint or joints to obtain the optimal scrubbing angle on a mop head and mop handle. In particular, there is need for an attachment that carries surface scrubbing elements, and which can easily and rapidly be connected to a mop handle, and preferably to mop handles of different configurations at the connecting location on the mop handles. Additionally, there is a need to mount the scrubbing element on the mop handle near the mop headband such that the scrubbing and or scraping element plate lies under the mop during operation.

BRIEF SUMMARY OF THE INVENTION

It is an object of the DuraLock scrubber attachment to provide method and apparatus meeting the above need. Basically, the improved apparatus provides a surface scrubbing element or elements, which can be comprised of bristles, abrasive pads or other scrubbing materials that can be attached to a handle such as the Ecolab, Inc., DuraLoc Wet Mop Handle or similar design with a similar mop head holder. As will be seen, the scrubbing element is configured for removable mounting to the mounting connection on the mop head holder, at or near the mop head. The mop head holder on the mop handle is either integrated in the molding of the handle or glued, threaded, inserted, riveted, or otherwise attached to the mop handle. The mounting connection on the mop head holder will be located on either side of the mop head holder, located at the end of the mop handle near the mop headband.

It is another object of the DuraLock scrubber attachment to provide an attachment secured to the mop head holder by allowing the mop handle to pass through a holding ring and utilizing fingers that fit into sockets on the mounting connection incorporated into the mop head holder. The scrubbing element can be removable and replaceable from the mop head holder without requiring removal of the mop head from the mop head holder, to allow a user to quickly replace or change the scrubbing element.

It is another object of the DuraLock scrubber attachment to provide flexible joints to allow the scrubbing element to bend relative to the mop handle to provide an optimal flat scrubbing surface. Because the scrubbing element is interchangeable, the dimensions and the scrub surfaces can be quickly changed, for example to clean a corner, narrow passage or a wide walkway, to allow for cleaning underneath low equipment or furniture, to allow for high and low spots on cleaning surfaces and to allow for efficient change in scrubbing materials.

Yet another object of the DuraLock scrubber attachment is to provide apparatus as referred to above which includes an element carrying scrubbing materials, that section having one or more flexible joints to the back plate of the DuraLock mounting connection. That plate may also advantageously include one or more flexible joints molded in position during plastic molding of the attachment, to accommodate and facilitate flap folding. The scrubbing elements may be carried by another plate which has attachment to the plate portion of the scrubbing element. Abrasive materials and scrubbing bristles may be glued, fused, staple set or otherwise attached in position to the plate portion, or other carrier which would be attached to the plate portion, as will be seen.

It is another object of the DuraLock scrubber attachment to not require the removal of the mop head during replacement of the scrubbing element, nor does it require removal of the scrubbing element in order to replace the mop head.

In still another embodiment the Duralock scraper is disclosed where replaceable scraping elements can be quickly installed, removed and replaced from the mop handle without removal of a securing head from the mop handle. This allows a person to quickly scrape and remove stuck debris from the floor without bending over.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
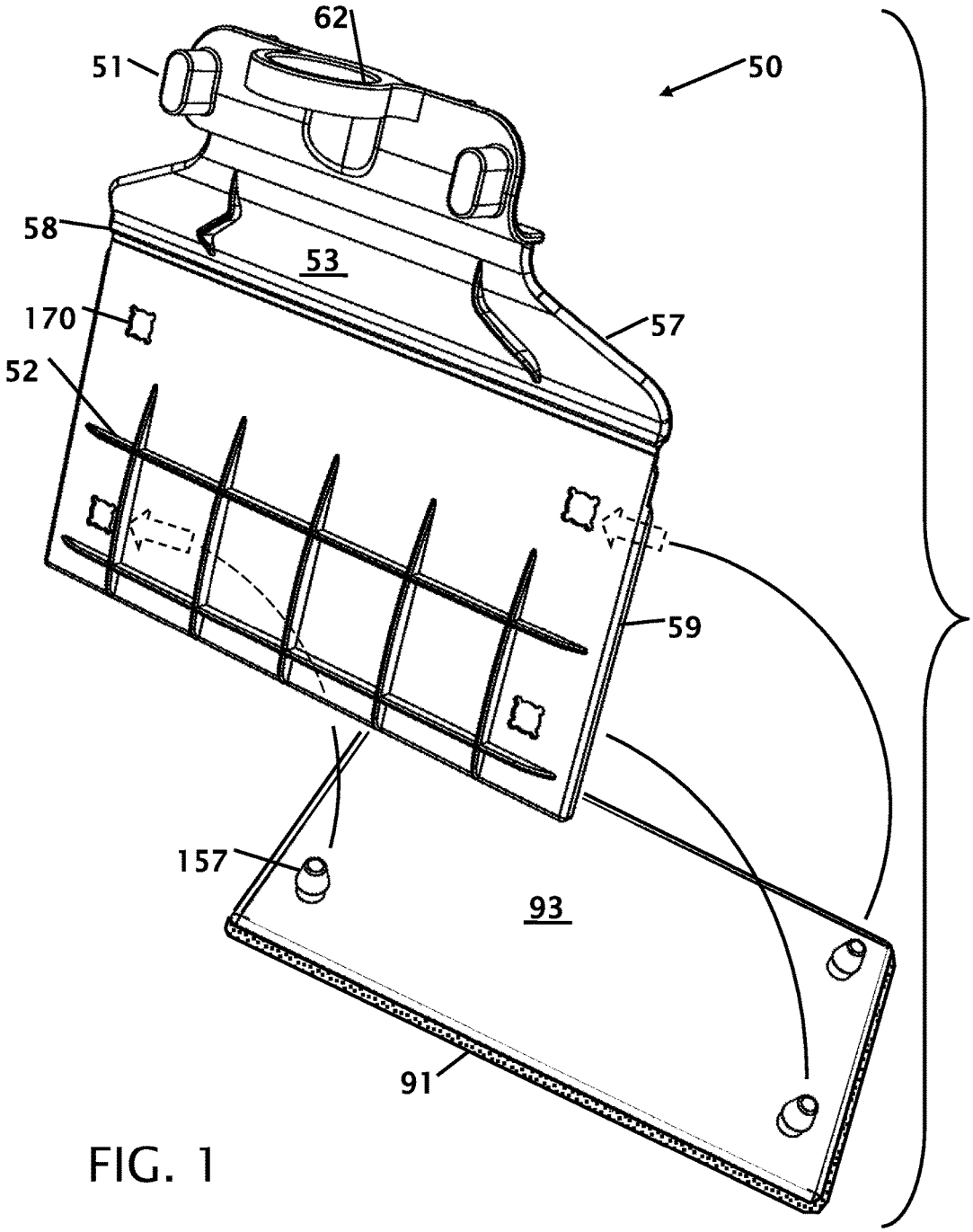
FIG. 1 is a perspective view of a DuraLock scrubber attachment.

FIG. 1 is a perspective view of a DuraLock scrubber attachment showing the removable portion 50 from a mop head holder. The removable portion 50 has a mounting back plate 53 having a pair of fingers 51 that extend into the mop head holder and a hole where the mop handle passes through the holding ring 62. The back plate has a rigid plate structure 57 that maintains a parallel relationship with the mop handle. One or more flexible joints 58 connect the back plate 53 to a brush, pad or securing plate 59. The securing plate 59 has a plurality of apertures 170. The brush or scrubber securing plate 59 bends or flexes on the flexible joint 58. Stiffening ribs 52 on the scrubber securing plate 59 are for structural purposes. In this embodiment, a replaceable scrubber plate 93 supports an abrasive surface 91. In other embodiments, the scrubber plate 93 bristles or other surfaces. The replaceable scrubber plate 93 has a plurality of projections 157 that engage into the apertures 170 in the plate 59.

Figure 2:
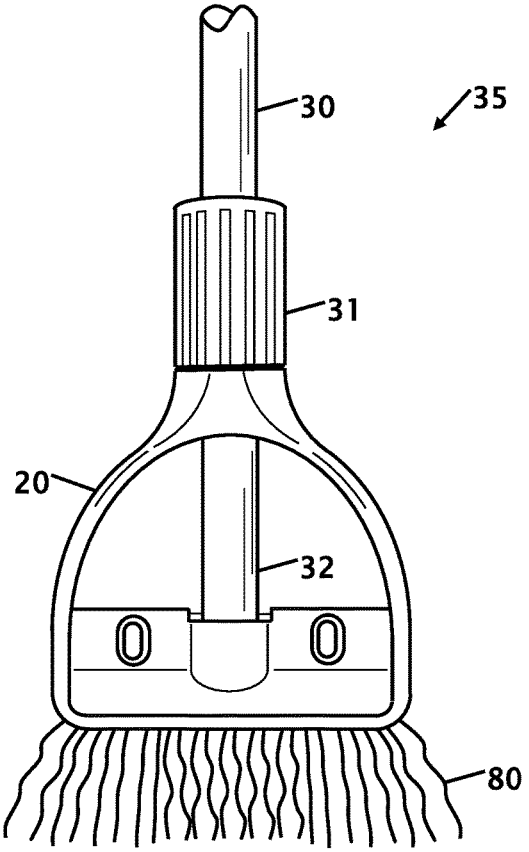
FIG. 2 is a plan view of the mop handle and mop head holder in an assembled orientation.
Figure 3:
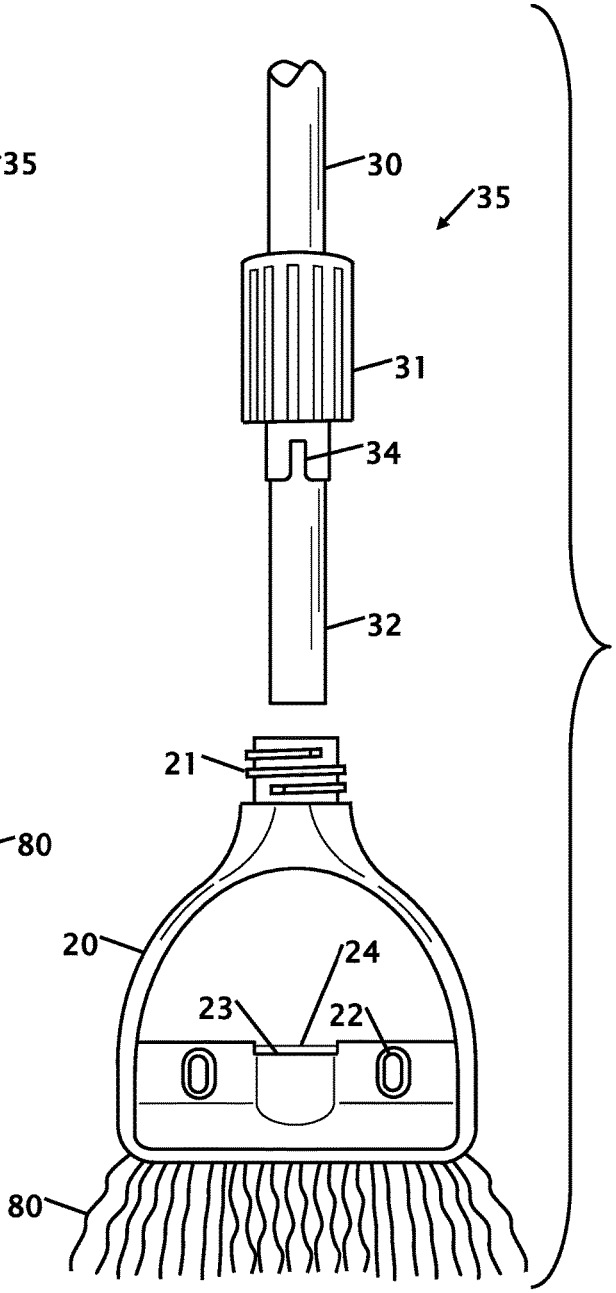
FIG. 3 is a plan view of the mop handle and mop head holder in an unassembled orientation.

FIG. 2 is a plan view of the mop handle and mop head holder in an assembled orientation and FIG. 3 is a plan view of the mop handle and mop head holder in an unassembled orientation. The entire mopping apparatus 35 has a handle portion 30 that is removable from the lower section. The mop handle 30 has a coupling 31 with a key 34 that maintains the proper orientation of the handle to the mop head holder 20. The shaft 30 of the handle extends through the coupling 31 where the lower portion of the handle 32 secures into the mop head holder at 23. The mop head holder portion 20 has a threaded coupling 21 that secures in the coupling 31 in the handle. The mop head holder has sockets 22 where the fingers 51 (shown in FIG. 1) engage for securing. The lower portion of the handle 32 fits through the threaded coupling 21, then through the holding ring 62 (shown in FIG. 1), and then into the mop head holder at 23 to secure the mop head holder and the DuraLock scrubber attachment. A release lever 24 may be incorporated to remove the mop 80 from the handle.

Figure 4:
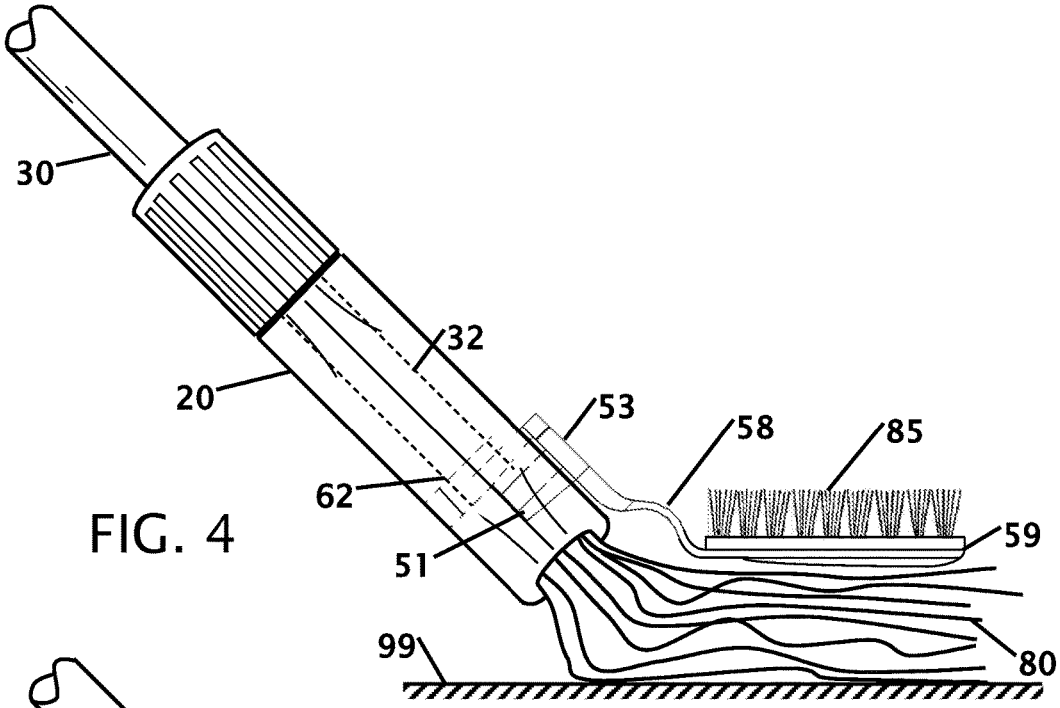
FIG. 4 is the DuraLock scrubber attachment on the mop handle being used in a first orientation.
Figure 5:
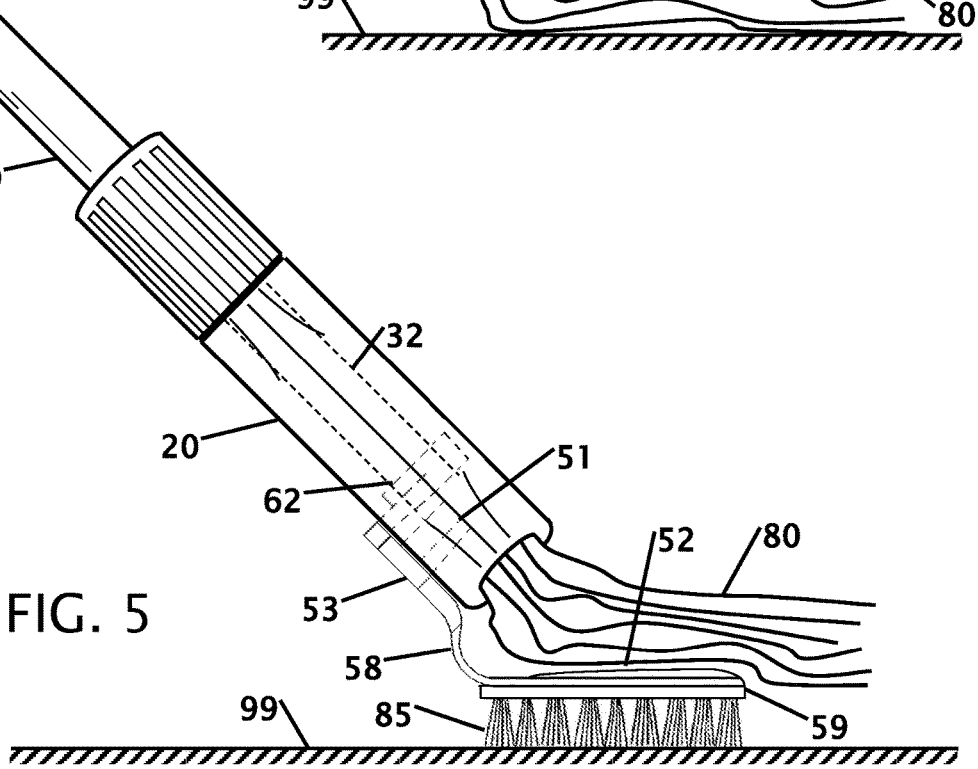
FIG. 5 is the DuraLock scrubber attachment on the mop handle being used in a second orientation.

FIG. 4 is the DuraLock scrubber attachment on the mop handle being used in a first orientation and FIG. 5 is the DuraLock scrubber attachment on the mop handle being used in a second orientation. In both figures, the flexible joint 58 is shown bending with the mop strands 80 to use the brush 85 as shown in FIG. 5 or to keep the brush 85 away from the surface 99, in FIG. 4. In FIG. 5, the tilted position for floor scrubbing by bristle group 85 engages with surface 99. Note that handle 30 can be tilted substantially horizontally or vertically. Connection plate section 53 allows the removable connection between the DuraLock that connects to the mop head holder 20. Because this is an interchangeable/replaceable component, a cleaning person can switch between a DuraLock brush 85 and a different DuraLock attachment of a different scrubbing material. The head mop strands 80 also engage the surface 99.

The scrubber securing plate 59 supports the brush bristles 85 in a flat structure. The DuraLock scrubber attachment is shown secured to the lower mop handle 32 through the threaded coupling 21, then through the holding ring 62 into the mop head holder 23 with fingers 51 engaged in the mop head holder sockets 22. The backing plate 59 includes a plurality of structural ribs 52 that are engaged with the mop head.

Figure 6:
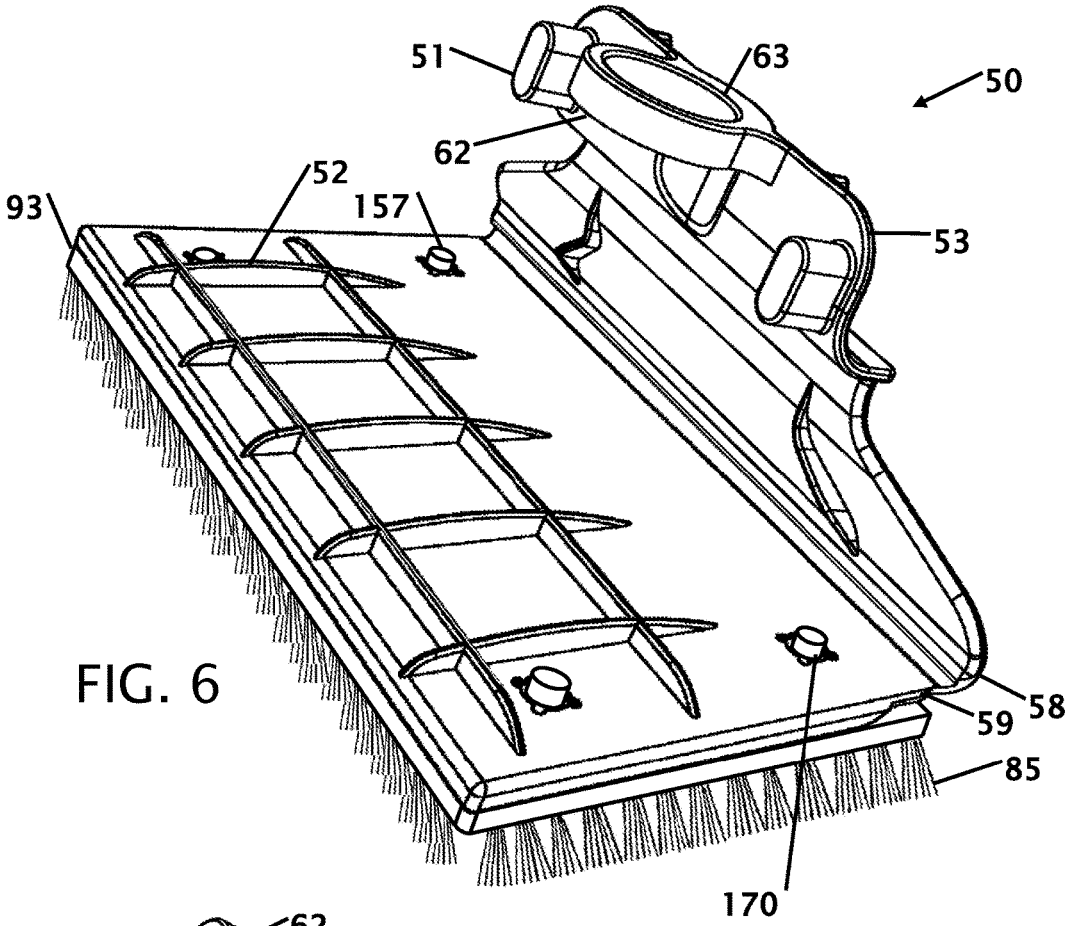
FIG. 6 is a side perspective view of the DuraLock scrubber attachment.
Figure 7:
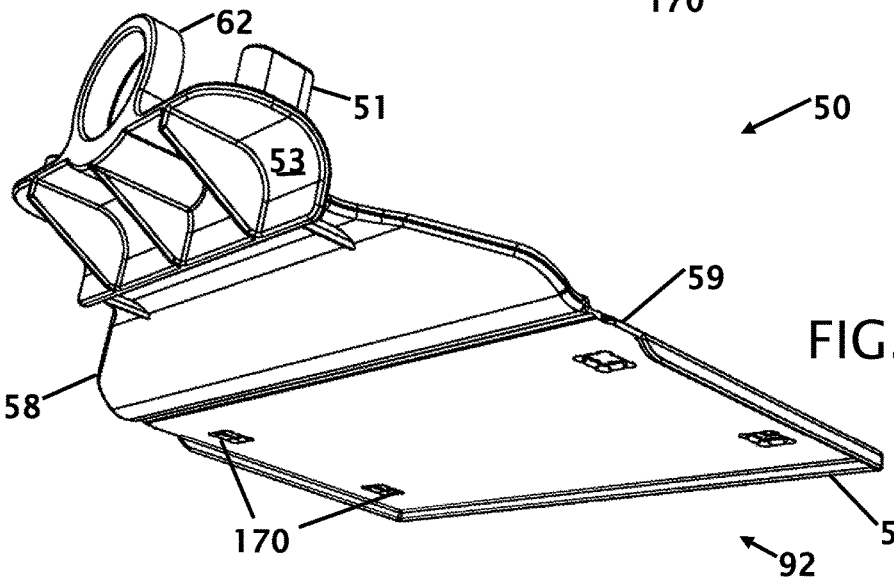
FIG. 7 is an opposite side perspective view of the DuraLock scrubber attachment showing the pad/bristles or other scrubbing material securing side.

FIG. 6 is a side perspective view of the DuraLock scrubber attachment and FIG. 7 is an opposite side perspective view of the DuraLock scrubber attachment showing the pad/bristles or other scrubbing material securing side. The replaceable scrubber plate 93 has a plurality of projections 157 that engage into the apertures 170 in the plate 59.

The removable portion 50 has a mounting back plate 53 having a pair of fingers 51 that extend into the mop head holder 20 and a holding ring 62 where the mop handle passes the holding ring. The back plate 53 has a rigid plate structure that maintains a parallel relationship with the mop handle. One or more flexible joints 58 connect the back plate 53 to a scrubber securing plate 59. The scrubber securing plate 59 bends or flexes on the flexible joint 58. In this embodiment, the scrubber plate 59 has no flexible joints. In other embodiments, the scrubber securing plate 59 may be comprised of multiple flexible joints. Stiffening ribs 52 on the scrubber securing plate 59 are for structural purposes. The underside 92 of the scrubber securing plate 59 is where scrubbing materials would be glued, fused, staple set or otherwise attached or where a plate 154 containing scrubbing elements (as in FIG. 8) would be connected. The apertures 170 of the plate 154 are visible extending through the removable portion 50.

Figure 8:
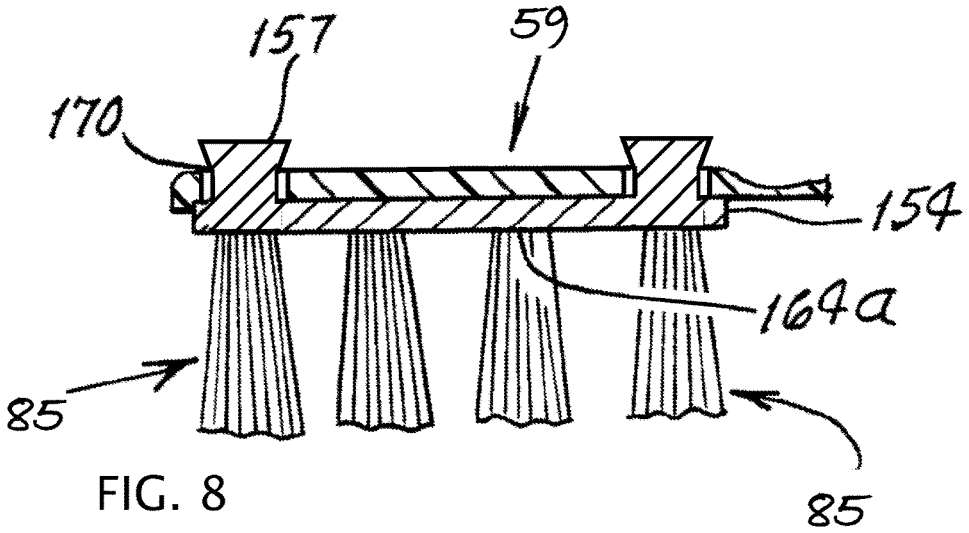
FIG. 8 is a view like FIG. 6 showing another mode of scrubbing element, to which the scrubbing materials are attached and then the plate of that element is attached to the DuraLock scrubber attachment.

FIG. 8 is a side view of an embodiment where the scrubbing materials, either abrasive pads or bristles or the like are glued, fused, staple set or otherwise attached to a plate, which is then attached removably to the scrubber securing plate 59. The apertures 170 in scrubber securing plate 59 receive projections 157 carried by a plate **164*a*. The bristle 85 plate 164*a* is attached to scrubber securing plate 59, wherein projections 157 extend through apertures 170 in scrubber securing plate 59**.

While a particular connection between the mop head holder and the DuraLock element is shown, and described, the components can take various other configurations for securing the components and the connection features can be placed on either side of the mop head holder. Further, while one flexible joint is shown on the DuraLock replaceable scrubbing element, it is contemplated that more than one flexible joint can be incorporated into the plate 59 and the flexible joint described as 58.

Figure 9:
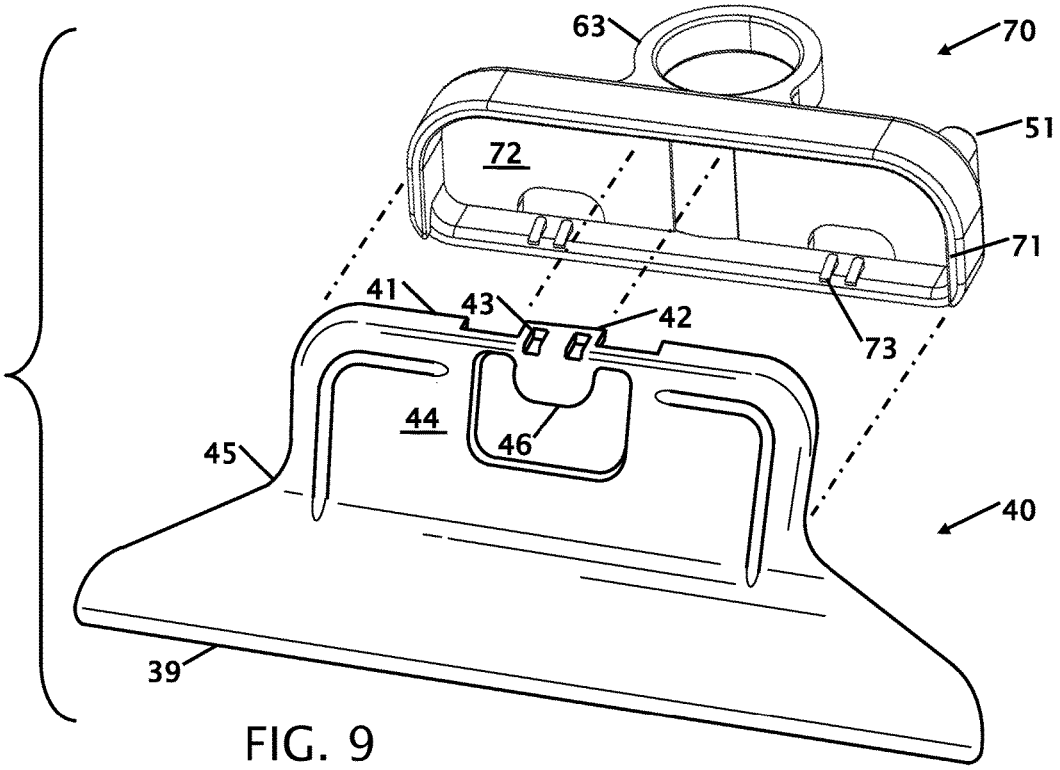
FIG. 9 is an exploded view of the DuraLock scraper attachment.

FIG. 9 is an exploded view of the DuraLock scraper attachments 40 and 70. The attachments include the head unit 70 that secures to the mop handle. The mop handle passes through hole 63. The removable portion 70 has a mounting back plate having a pair of fingers 51 that extend into the mop head holder and a hole 62 where the mop handle passes through the holding ring. The back plate 70 has a rigid plate structure that maintains a parallel relationship with the mop handle. The back plate 70 has an outer rim or wall 71 with a recessed pocket 72. Within the pocket 72 is a plurality of retention features 73 or hooks. The pocket 72 and the retention features secure a variety of interchangeable components. In this figure, the interchangeable component is a floor scraper 40.

The floor scraper 40 has a face 44 with an outer wall 41 that fits within the recessed pocket 72. The scraper 40 has an angled surface that bends through radius 45. The bend places the scraper at an optimal angle. The floor scraper 40 terminates at an edge 39 that engages on a floor surface to remove gum or other debris that has attached to a floor. The floor scraper 40 has complementary securing features 43 that engage in the securing features in the back plate 70. The top securing features 43 exist on a tab 42 that flexes to lock into the back plate 70. A finger tab 46 allows for bending the tab 42 to remove the floor scraper 40 from the back plate 70. The floor scraper 40 is preferably made of plastic or metal.

Figure 10:
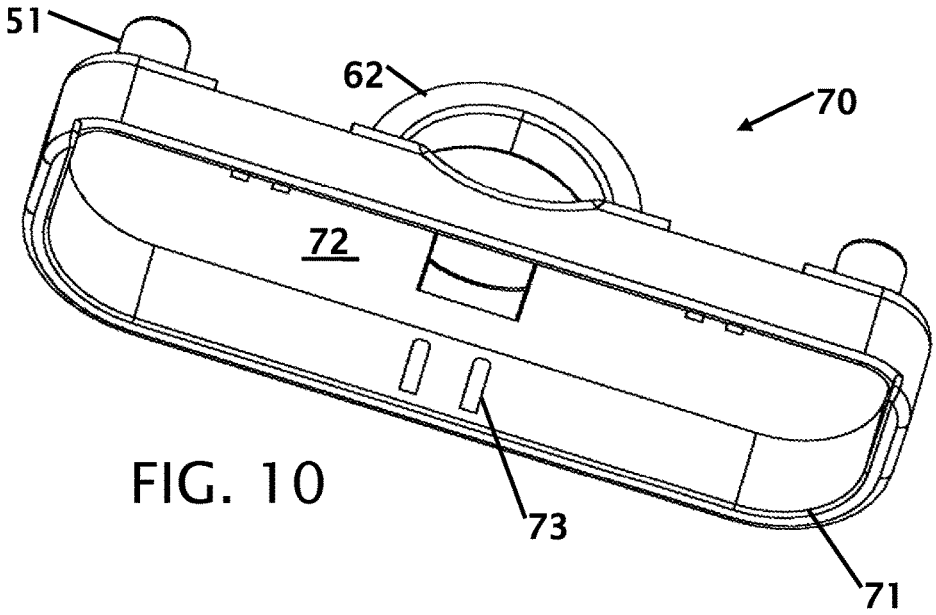
FIG. 10 is a perspective view of the DuraLock mounting base.
Figure 11:
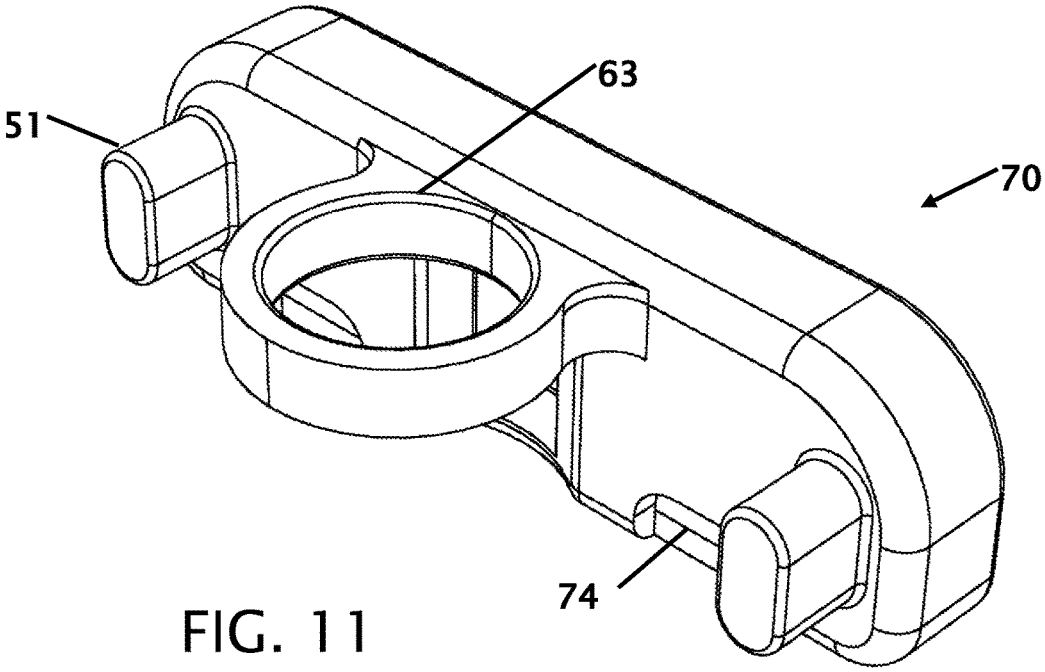
FIG. 11 is an alternate perspective view of the DuraLock mounting base.

FIG. 10 is a perspective view of the DuraLock mounting back plate 70 or head unit and FIG. 11 is an alternate perspective view of the DuraLock mounting base 70. From these figures the recess pocket 72 is shown with the structural rim or lip 71 extending around the recessed pocket 72. The structural rim 62 that supports the mop pole through the hole 63 is shown in both figures. The pair of fingers 51 or protrusions are shown extending from the back plate. In FIG. 10, the securing hooks 73 are visible, and in FIG. 11, the opening 74 that forms the hooks is visible.

Figure 12:
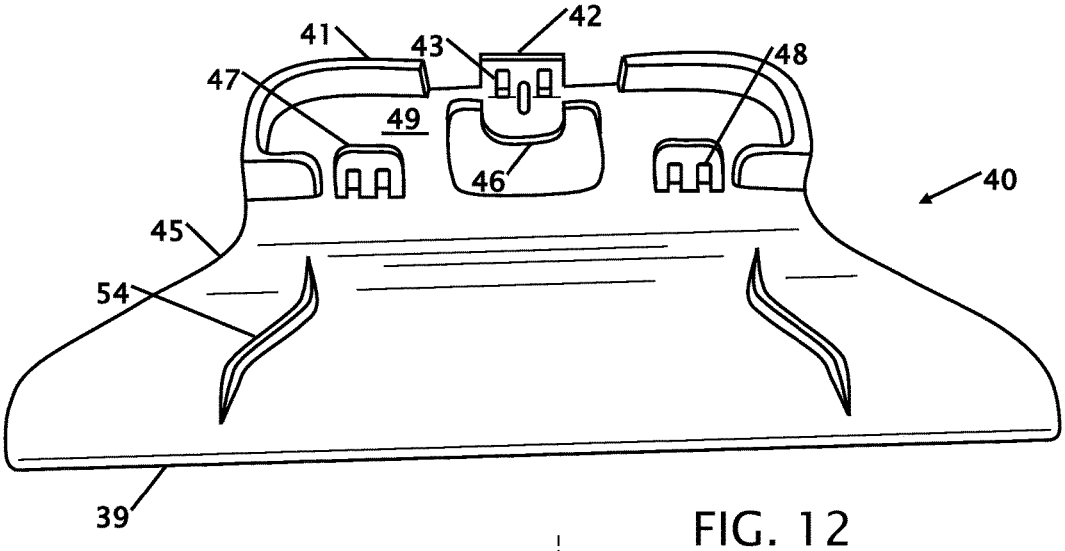
FIG. 12 is perspective view of the DuraLock scraper.

FIG. 12 is perspective view of the DuraLock scraper 40. The floor scraper 40 has a face 49 with an outer wall 41. The scraper 40 has an angled surface that bends through radius 45. The bend places the scraper at an optimal angle. The floor scraper 40 terminates at an edge 39 that engages on a floor surface to remove gum or other debris that has attached to a floor. The floor scraper 40 has complementary securing features 43 that engage in the securing features in the back plate. The top securing features 43 exist on a tab 42 that flexes to lock into the back plate. A finger tab 46 allows for bending the tab 42 to remove the floor scraper 40 from the back plate. Elevated tabs 47 have securing locks 48 that temporally locks the floor scraper 40 on the back plate. The floor scraper 40 has structural ribs 54 to help the scraper to maintain a rigid scraping edge 39 to remove gum or other stuck debris from a floor.

Figure 13:
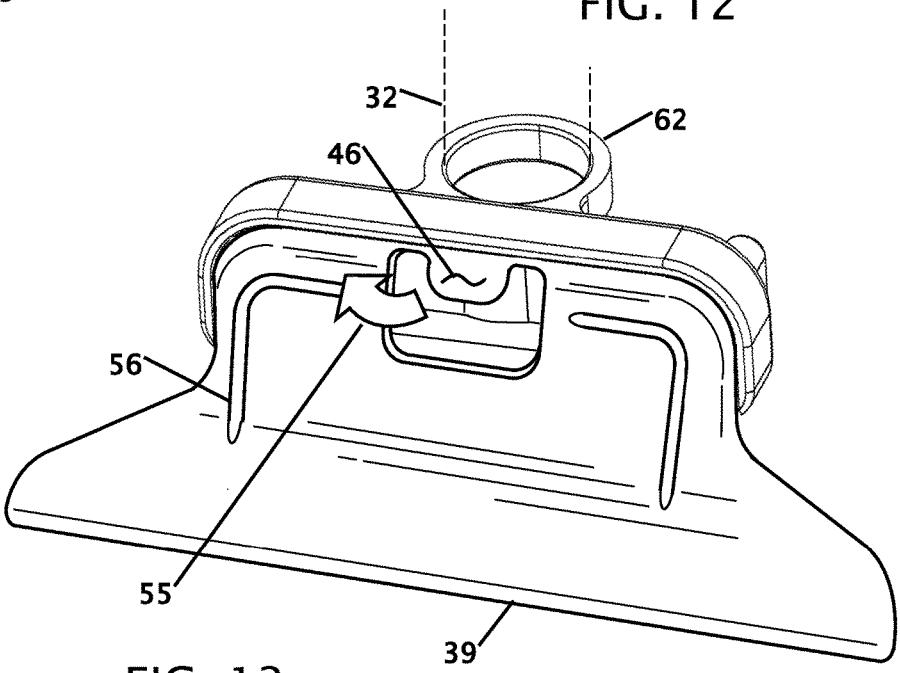
FIG. 13 is as assembled view of the DuraLock scraper attachment installed in the mounting base.

FIG. 13 is as assembled view of the DuraLock scraper attachment installed in the mounting base with a mop handle 32 that extends through the hole in the holding ring 62. This view of the scraper 39 shows additional structural ribs 56 to reduce bending on the support structure of the scraper. This figure shows that the tab 46 is lifted 55 to bend the locking tabs out of the way and allow the scraper to be removed from the back plate. This allows a worker to install, replace and remove the scraper. The scraper provides minimal interference of the mop.

From the figures in this disclosure provide for providing a DuraLock scrubber attachment 50 that is securable to a mop handle 32 having a mop head holding section which has a hole 63 where the mop handle 32 passes. The DuraLock scrubber attachment 50 has one or more fingers 51 in the back plate 53 that is configured to engage in sockets 22 of the mop head holder and a hole 63 whereby the mop handle 32 passes. The DuraLock scrubber attachment 50 has at least one flexible joint 58 between the back plate 53 and the one or more engaging fingers 51 and a scrubber securing plate 52. The backing securing plate 52 supports a replaceable scrubber plate 93 wherein scrubbing materials are attached or wherein another plate containing scrubbing materials is attached. The scrubbing element is provided as a floor scrubber, and the replaceable scrubber plate 93 has locking feature 157 that temporally secures the replaceable scrubber plate 93 to the backing plate 59.

The locking feature is a plurality of apertures 170 in the backing plate 52. The locking feature is a plurality of protrusions 157 in the replaceable scrubber plate 93. The floor scrubber 93 is selected from a group consisting of bristles 85, pads 91 or other abrasive materials. The bristles 85 have supporting portions fused to a base 154 defined by the device. The scrubber defines projecting floor scrubbing 85 elements. The flexible joint 85 is a living hinge. The flexing joint is positioned (as shown in FIG. 5) to support the replaceable scrubber plate 59 by the mop handle 30. FIG. 4 shows that the flexible joint 58 flexes above the mop head. The backing plate 59 includes a plurality of structural ribs 52 that are engaged with the mop head.

The DuraLock scraping attachment has interchangeable surface scraping capability, that includes a scraping attachment 40 that can be secured to a mop handle 32 having a mop head holding section 70 which has a hole 63 where the mop handle 32 passes. The mop head holding section 70 has one or more fingers 51 in the back plate 72 configured to engage in sockets 22 of the mop head holder and a hole 63 whereby the mop handle 32 passes. The scraping attachment 40 has a securing head unit that extends from the hole 63. The securing head 70 supports a replaceable scraping element 40 that is removably secured to the securing head 70. The scraping element 40 provides a floor scraper in the form of a plate attached by a flexing bend 45 that extends away from the mop head.

The back plate 70 has a recess 72. The backing plate 70 has a supporting rib structure 71 that extends around the recess 72. The supporting structure rib 71 has a plurality of securing hooks 73. The replaceable scaping element 40 has a plurality of complimentary locks 48 that temporarily retain the replaceable scraping element 40 in the securing head 70. The replaceable scraping element 40 has a back plate 44 and an outer rim 41, and the outer rim 41 engages into the supporting rib structure 71 of the backing plate 70. The replaceable scraping element 40 has a flexible tab 46 that is articulated 55 to release the replaceable scraping element 40 from the backing plate 70. The replaceable scraping element 40 has a scraping edge 39 that flairs from the securing head 70. The replaceable scraping element 40 has a plurality of structural ribs 54, 56 that extend through the flexing bend 45. The replaceable scraping element is made of plastic or metal.

Figure 14:
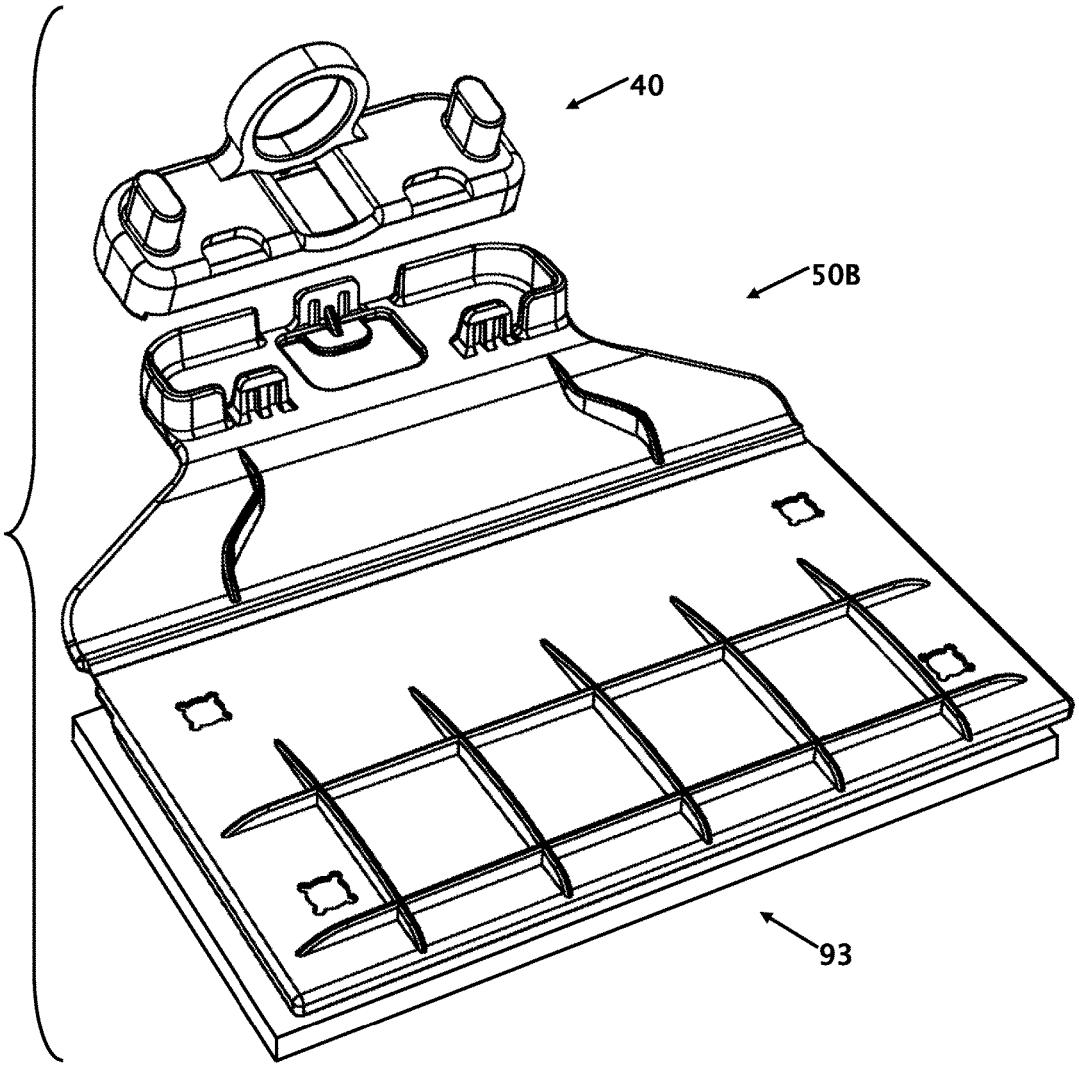
FIG. 14 shows an alternate embodiment of the DuraLock scrubber attachment on the mounting base.

FIG. 14 shows an alternate embodiment of the DuraLock scrubber attachment on the mounting base. It should be understood that the connection between the back plate 70 can be applied to other quick disconnect and replaceable brushes, scrubbers and other attachments like the embodiment of the flexible attachment 50B, in this figure, with the replaceable scrubber plate 93 that has been previously shown and described.

Thus, specific embodiments of a replaceable scrubbing and scaping element attachable to a mop handle have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A DuraLock scrubber attachment with interchangeable surface scrubbing capability, that includes:

a) providing a DuraLock scrubber attachment that is securable to a mop handle having a mop head holding section which has a hole where said mop handle passes;

b) said DuraLock scrubber attachment has one or more fingers in a back plate configured to engage in sockets of said mop head holding section and said hole;

c) said DuraLock scrubber attachment has at least one flexible joint between a backing securing plate with one or more engaging fingers and a scrubber securing plate;

d) said backing securing plate supports a replaceable scrubber plate wherein scrubbing materials are attached or wherein another plate containing scrubbing materials is attached;

e) wherein a scrubbing element is provided a floor scrubber, and f) said replaceable scrubber plate has locking feature that temporally secures said replaceable scrubber plate to said backing securing plate.

2. The DuraLock scrubber attachment of claim 1, wherein said locking feature is a plurality of apertures in said backing securing plate.

3. The DuraLock scrubber attachment of claim 2, wherein said locking feature is a plurality of protrusions in said replaceable scrubber plate.

4. The DuraLock scrubber attachment of claim 1, wherein said floor scrubber is selected from a group consisting of bristles, pads or other abrasive materials.

5. The DuraLock scrubber attachment of claim 4, wherein the bristles have supporting portions fused to a base defined by the device.

6. The DuraLock scrubber attachment of claim 1, wherein said floor scrubber defines projecting floor scrubbing elements.

7. The DuraLock scrubber attachment of claim 1, wherein said flexible joint is a living hinge.

8. The DuraLock scrubber attachment of claim 1, wherein said flexible joint is positioned to support said replaceable scrubber plate by said mop handle.

9. The DuraLock scrubber attachment of claim 8, wherein said flexible joint flexes above said mop head.

10. The DuraLock scrubber attachment of claim 8, wherein said backing securing plate includes a plurality of structural ribs that are engaged with said mop head.

11. The DuraLock scrubber attachment of claim 1, wherein said back plate includes at least two fingers.

12. The DuraLock scrubber attachment of claim 11, wherein said at least two fingers are configured to engage in a said mop head holding section.

13. The DuraLock scrubber attachment of claim 12, wherein said at least two fingers reduce rotation of said DuralLock scrubber attachment on said mop holding section.

14. The DuraLock scrubber attachment of claim 1, wherein said flexible joint is perpendicular to said hole.

15. The DuraLock scrubber attachment of claim 1, wherein flexible joint has a pocket.

16. The DuraLock scrubber attachment of claim 15, wherein said pocket supports a scrapper.

17. The DuraLock scrubber attachment of claim 15, wherein said scraper is temporally securable on said pocket.

18. The DuraLock scrubber attachment of claim 15, wherein said scraper is flexible relative to said pocket.

19. The DuraLock scrubber attachment of claim 15, wherein said pocket has at least one retention hook.

20. The DuraLock scrubber attachment of claim 15, wherein said scraper is angled from said back plate.

* * * * *